United States Patent [19]

Tölle

[11] Patent Number: 4,993,705

[45] Date of Patent: Feb. 19, 1991

[54] ATHLETIC DEVICE

[76] Inventor: Gerhard-Hugo Tölle, D - 4938 Schieder-Schwalenberg 2, Fed. Rep. of Germany

[21] Appl. No.: 272,696

[22] PCT Filed: Mar. 11, 1988

[86] PCT No.: PCT/EP88/00191

§ 371 Date: Nov. 16, 1988

§ 102(e) Date: Nov. 16, 1988

[87] PCT Pub. No.: WO88/06908

PCT Pub. Date: Sep. 22, 1988

[30] Foreign Application Priority Data

Mar. 17, 1987 [DE] Fed. Rep. of Germany ..... 3708567

[51] Int. Cl.[5] ..... A63B 21/02

[52] U.S. Cl. ..... 272/139; 272/142; 272/143

[58] Field of Search ..... 272/139, 142, 137, 135, 272/119, 71, 143, DIG. 9; 128/869, 870, 874–876; 2/44, 94, 102

[56] References Cited

U.S. PATENT DOCUMENTS

| | | | |
|---|---|---|---|
| 1,402,179 | 1/1922 | Piscitelli | 272/139 |
| 1,663,641 | 3/1928 | Smallwood | 272/139 |
| 2,035,010 | 3/1936 | Rawlings | 272/142 |
| 4,033,580 | 7/1977 | Paris | 272/137 |
| 4,065,814 | 1/1978 | Fox | 272/139 |
| 4,273,328 | 6/1981 | Ozbey et al. | 272/137 |
| 4,544,155 | 10/1985 | Wallenbrock | 272/137 |
| 4,815,729 | 3/1989 | Stefanski | 272/139 |

FOREIGN PATENT DOCUMENTS

| | | | |
|---|---|---|---|
| 449168 | 9/1927 | Fed. Rep. of Germany | 272/142 |
| 20463 | of 1907 | United Kingdom | 272/139 |
| 245274 | 1/1926 | United Kingdom | 272/139 |

*Primary Examiner*—Richard J. Apley
*Assistant Examiner*—D. F. Crosby
*Attorney, Agent, or Firm*—Browdy and Neimark

[57] ABSTRACT

An athletic device for training the muscles of the upper body, in particular the arm muscles, in the course of running and walking, comprising a vest to be worn by a user, an elastically expandable strap removably disposed fastened in place across a back part of the vest and having at its ends two cuff means for connection to the arms of the user.

17 Claims, 4 Drawing Sheets

ATHLETIC DEVICE

FIELD OF THE INVENTION

The invention relates to an athletic device for training the muscles of the upper body, in particular the arm muscles, in the course of running and walking, having an elastically expandable strap.

BACKGROUND OF THE INVENTION

During athletic endurance and weight training the intention is to stress portions of the skeletal muscles as large as possible over extended periods of time. This is the case, for example, during cross-country skiing or during swimming, i.e. in the course of types of athletics which have been particularly lauded time and again for their beneficial effects on the body.

During running and walking, which are the natural means of human propulsion, the legs alone are almost exclusively used and the arms perform involuntary load-free motions during running or walking.

In order to put more of a load on the limbs, weights are strapped to the wrist and ankles; however, these weights offer more of a resistance to the corresponding flexor muscles. However, during running and walking the more important muscles are the extensor muscles which support the body and trigger a jump.

SUMMARY OF THE INVENTION

It is an object of the invention to provide a simple, cost-effective but efficient athletic device which provides a load on the arms, and thus on the upper body during running and walking, thereby leading to excercise of the entire body similar to that during swimming or cross-country skiing.

This object is attained by the invention by providing an expandable strap, extending transversely, removably fastened in place across the back part of a vest having two arm and/or wrist cuffs at its ends. Several characteristics recited in the dependent claims represent advantageous improvements in the attainment of the object.

The subject of the invention not only extends to the characteristics of the individual claims but also to their combination.

The athletic device according to the invention acts on the involuntarily swinging arms during running and walking, because of which a constant counterforce is created, which must be overcome by the arms, by means of which the muscles of the arms and upper body are strengthened.

At least two regions of an elastically expandable strap of the athletic device cross on the back of the wearer at the height of the shoulder blades and are each guided in opposite directions over the shoulder of the one side and under the armpit of the other side. They act on the forearms, on which they are fastened by means of adjustable cuffs or armbands. The expandable strap extends in the form of a figure eight and is guided through the loops of a vest. The crossing point of the expandable strap is located at the height of the shoulder blades.

The shoulder and the back are protected against rubbing and the pressure of the straps by the vest on which the elastic straps are fixed. Furthermore, the vest maintains the expandable strap in the required position (course) and makes trouble-free putting on and removal of the athletic device possible.

The advantages obtained by means of the invention consist in making training by means of running more effective. Because of the concurrent load on the arms they are additionally made to move increasingly, by means of which it is intended to smooth out the course of movement and to improve the coordination of the entire movement.

As during swimming or cross-country skiing, the entire body is then also strengthened during running and walking. Additionally, there is no requirement for using up time for a compensating strengthening of the upper body by means of boring stationary weight training.

The athletic device is constructed simply and cost-effectively, easy to use and has a high intrinsic value because of its high effectiveness.

BRIEF DESCRIPTION OF THE DRAWINGS

Exemplary embodiments are described in detail by means of the drawings, in which.

DETAILED DESCRIPTION OF THE PREFERRED EMBODIMENTS

Figure 6:
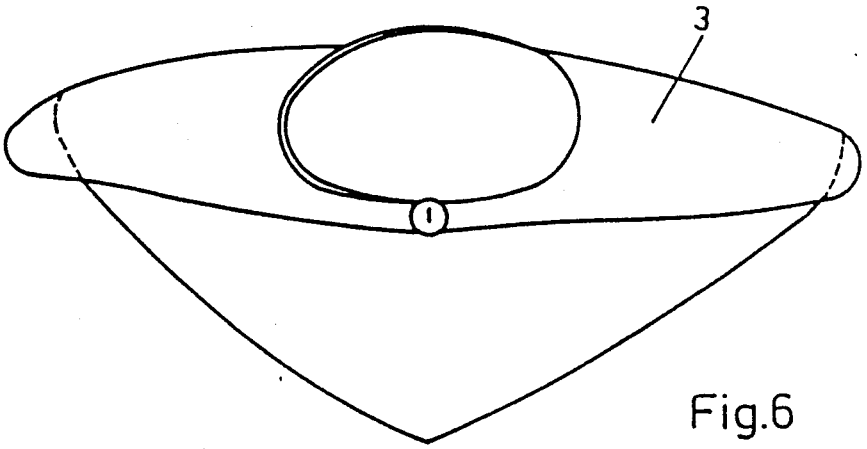
FIG. 6 is a perspective view of a cover as an additional part of the athletic device.

The athletic device comprises an elastic expandable strap (1), a vest (2) and, if desired, a cover (3) shown in FIG. 6. The expandable strap (1) is removably fastened in place and crosses on the back (*2a*) of the vest (2) and is provided with two arm or wrist cuffs (4) at its ends.

This expandable strap (1) is made of flat webbing of rubber and/or plastic, preferably having a rectangular cross section. Because of the flat design of the expandable strap (1), it rests on the back (5) and the shoulders (6) of the person using the athletic device without causing pressure marks or rubbing.

It is also possible to use an expandable strap (1) having a circular or oval cross section. Furthermore, tension springs may be provided in place of the expandable strap (1).

The vest (2) is provided on the outer surface of its back (*2a*) with a plurality of flaps (7) extending along two crossing lines from the area of the shoulders to the lower back, through which the expandable strap (1) is guided and thus maintained in a crosswise or transverse manner on the vest (2).

The expandable strap (1) is either securely maintained on the vest (2) by closed flaps (7), or the flaps (7) are removably fixed with one end on the vest (2) by snap closures or other types of fastening means for inserting and removing the expandable strap (1), so that the expandable strap (1) can also be used without the vest (2).

Figure 1:
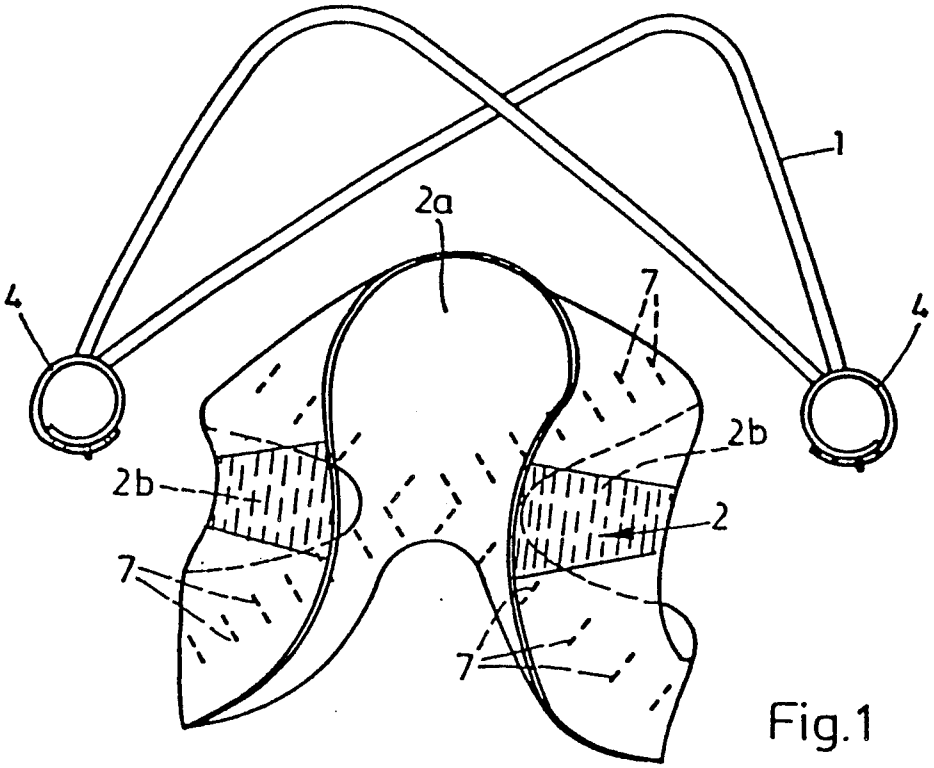
FIG. 1 is a perspective view of an athletic device composed of a vest and an expandable strap with the two parts separated.
Figure 4:
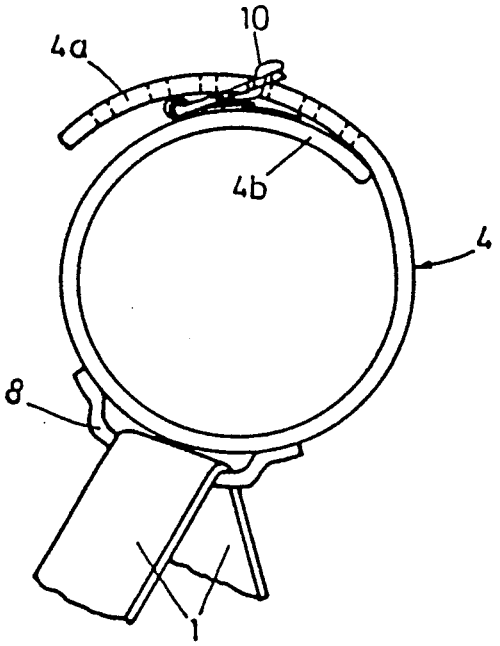
FIG. 4 is a front view of an adjustable arm and/or hand cuff disposed on the expandable strap.

The expandable strap (1) is in the shape of an endless strap and is guided through each one of a loop (8) of the two cuffs (4)(FIG. 4). Additionally, the expandable strap (1) may be formed of two straps which are fixed with both of their ends on the two cuffs (4)(FIG. 1).

Figure 7:
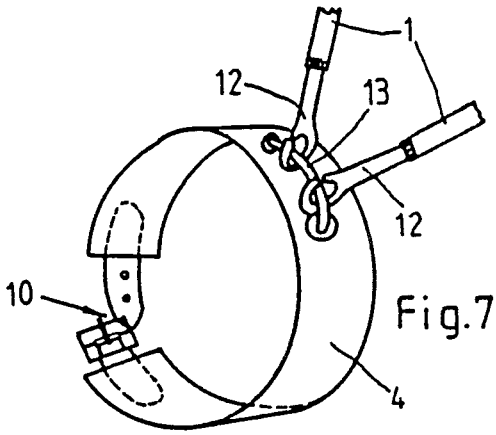
FIG. 7 is a perspective view of the cuff in a further development of the fastening of the expandable strap.
Figure 8:
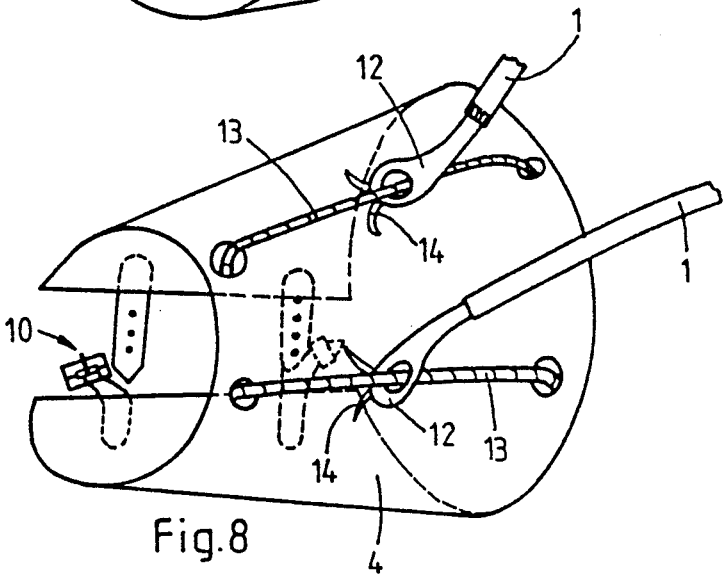
FIG. 8 is a perspective view of a conical cuff.

In accordance with the embodiment in FIGS. 7 and 8, the expandable strap (1) is provided with eyes (12) at its ends which surround fastening hoops (13) fixed on the cuffs (4). The expandable strap (1) is fixedly maintained on the cuffs (4) by the eyes (12), i.e. the strap sections cannot be displaced in respect to the cuff (4) (move away in the longitudinal direction), so that the strap (1) is maintained secure against slipping on the cuffs (4) and therefore the sections of the strap (1) are tensed and relaxed in the course of the oppositely directed movements of the arm and thus have an effect.

In a preferred manner the expandable strap (1) is adjustable in the longitudinal direction for the purpose of adjusting it to different body sizes on the one hand and, on the other, to adjust its tension.

Figure 5:
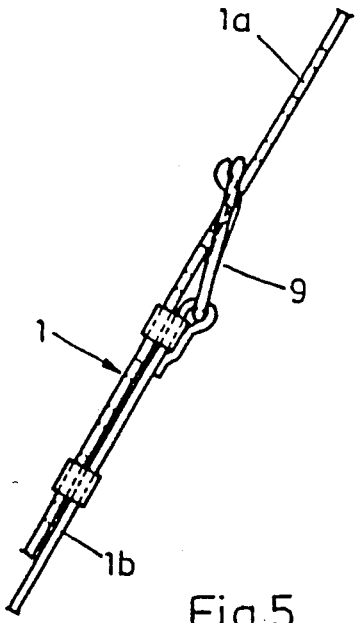
FIG. 5 is a lateral view of a partial longitudinal area of an expandable strap with longitudinal adjustment.

For this purpose the endless expandable strap (1) is separated at one point and the two ends (1*a*, 1*b*) of the expandable strap (1) are overlapped and are held together in the stepped or continuously variable longitudinal adjustment by a closure (9), such as a buckle, clamp, snap or hook closure or the like (FIG. 5).

In the case of the expandable strap (1) consisting of two straps, a separation and a closure (9) are provided on each strap.

The cuff (4) is formed by a padded ring or a closed flat band. It is also preferred to make the cuff adjustable for arms or wrists of different thickness, the cuff (4) also being separated, disposed with its two cuff ends (4*a*, 4*b*) overlapping and removably held together in a stepped or continously variable adjustment of its circumference by a closure (10), such as a buckle, clamp, snap or hook closure or the like.

FIG. 6 shows a cover (3) resting on the shoulders (6) and part of the back (5) of the person and covering a part of the expandable strap (1) and the vest (2), thus serving as a screen and insulator. This cover (3) may also be removably fastened on the vest (2), so that it partially covers the expandable strap (1). This cover (3) furthermore is a part of the athletic device for improving its visual appearance and serves as a protection in case the expandable strap (1) snaps by preventing uncontrolled recoil of the broken part of the strap.

The cover (3) can have various shapes and be made of a variety of materials and in various colors.

The cover (3), connected with the vest (2) if desired, forms an integral athletic device together with the expandable strap (1) and the cuffs (4) and can be simply and comfortably put on and removed.

Figure 3:
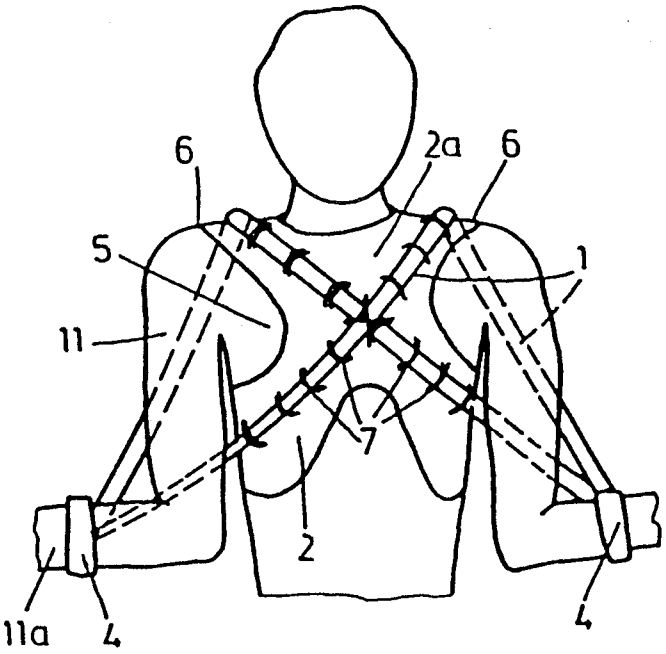
FIG. 3 is a rear schematic view of the athletic device during use.
Figure 2:
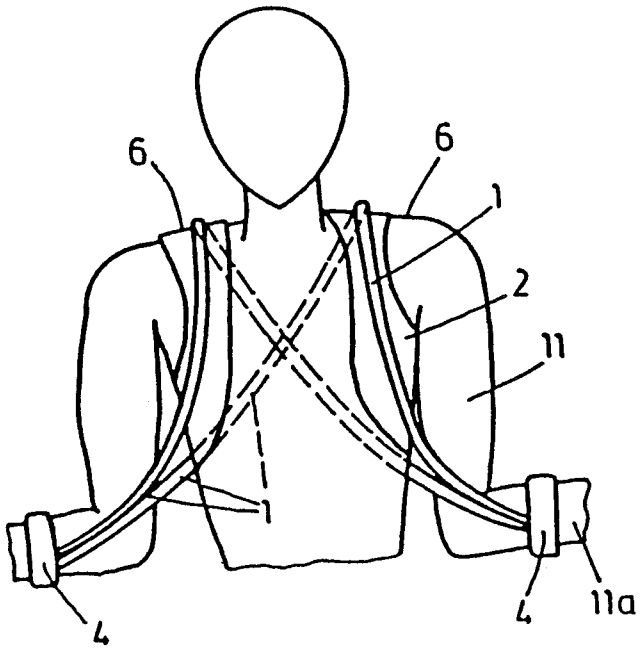
FIG. 2 is a front schematic view of the athletic device during use.

FIGS. 2 and 3 show the athletic device in use, where it is apparent that the expandable strap (1) crosses the back (5) of the person at the height of the shoulder blades and extends over the shoulders (6) and under the armpits and from there is routed with the ends of the straps, which each have a cuff (4), to the forearms (11*a*) or the wrists or the hands and fastened there, so that in the course of the arm movements a pulling force is exerted on the expandable strap (1) and in this way the arms (11) are subjected to an increased load. Thus the expandable strap (1) has strap areas or straps arranged in a figure eight which each extend in the form of a letter S across the back (5) and the shoulders (6).

Figure 9:
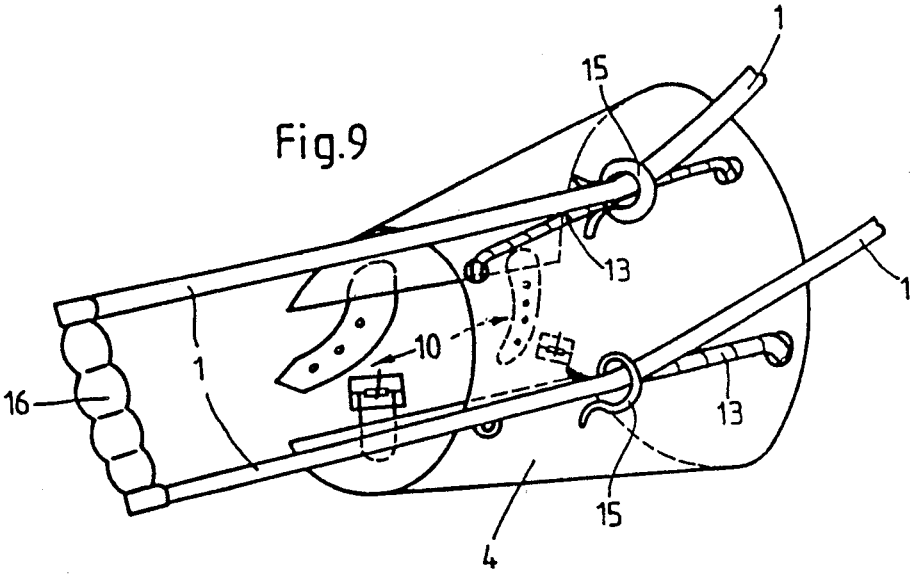
FIG. 9 is a perspective view of a cuff with the expandable strap extended to a grip.

A buckle closure (10) for the cuffs (4) is shown in FIGS. 7 to 9.

The cuff (4) is constituted by a flat cylindrical ring in accordance with FIG. 7, while the cuff (4) in accordance with FIGS. 8 and 9 is conical and corresponds to the longitudinal shape of the forearm, so that it firmly surrounds the forearm (11*a*).

The eyes (12) of the expandable strap (1) can be designed so that they slide around the fastening hoops (13) in order to obtain different lever actions. The displacement positions of the eyes (12) in relation to the fastening hoops (13) can be fixed by means of clamping elements (14) or the like.

In a further embodiment in accordance with FIG. 9 the ends of the expandable strap (1) are guided through clamping eyes (15) and are lengthened beyond the cuff (4) as far as a grip (16) at the end, so that the ends of the expandable strap are grasped at the grip (16).

The clamping eyes (15) are provided movable around the fastening hoops (13) and fixable (corresponding to the eyes (12)), by means of which a lever force can be selected and the muscles of the forearms (11*a*) can be stressed.

The vest (2) is provided with stretchable areas (2*b*) made of an elastic material in order to follow certain movements when the position of the expandable strap is changed.

I claim:

1. An athletic device for training the muscles of the upper body, in particular the arm muscles, in the course of running and walking, comprising a vest to be worn by a user, an elastically expandable flat rectangular cross sectioned strap removably disposed fastened in place across a back part of the vest and having at its ends two cuff means for connection to the arms or wrists of the user, wherein the expandable strap forms two strap areas which cross on the back of the person substantially at the height of the shoulder blades, which are alternately extended over the shoulder of one side and under the armpit of the other side and fastened with each of the strap areas on one of the cuff means.

2. An athletic device for training the muscles of the upper body, in particular the arm muscles, in the course of running and walking, comprising a vest to be worn by a user, an elastically expandable flat rectangular cross sectioned strap removably disposed fastened in place across a back part of the vest and having at its ends two cuff means for connection to the arms or wrists of the user, wherein the expandable strap is in the form of two crossing straps which are fastened with their ends on the two cuff means.

3. An athletic device in accordance with claim 2, wherein the expandable strap is in the form of an endless strap and is drawn through a loop of each of the cuff means.

4. An athletic device in accordance with claim 2, wherein the expandable strap is adjustable in the longitudinal direction, has at least one point of separation and has a closure connecting two crossed strap ends which are disposed overlapping each other.

5. An athletic device in accordance with claim 2, wherein the cuff means comprise cuffs formed by padded rings.

6. An athletic device in accordance with claim 2, wherein the cuff means comprise cuffs formed by flat bands.

7. An athletic device in accordance with claim 2, wherein each cuff is made adjustable in its circumference, has a separation point and has a closure detachably connecting two overlapping cuff ends.

8. An athletic device in accordance with claim 2, wherein each cuff is made adjustable in its circumference, has a separation point and has a closure detachably connecting two overlapping cuff ends.

9. An athletic device in accordance with claim 2, wherein the expandable strap is made of rubber.

10. An athletic device in accordance with claim 2, wherein the expandable strap is made of plastic.

11. An athletic device in accordance with claim 2, wherein the expandable strap comprises tension springs.

12. An athletic device in accordance with claim 2, wherein the cuff means are cone-shaped.

13. An athletic device in accordance with claim 2, wherein the ends of the expandable strap are movably guided by eyes, movable and arrestable on fastening hoops of the cuff means, and are connected at their ends with a grip.

14. An athletic device in accordance with claim 2, wherein the vest is provided with expandable areas made of an elastic material.

15. An athletic device for training the muscles of the upper body, in particular the arm muscles, in the course of running and walking, comprising a vest to be worn by a user, an elastically expandable flat rectangular cross sectioned strap removably disposed fastened in place across a back part of the vest and having at its ends two cuff means for connection to the arms or wrists of the user, further comprising a plurality of flaps provided on the outside of the back part of the vest and extending along two crossing lines from the area of the shoulders to the lower back, through which the expandable strap is guided.

16. An athletic device in accordance with claim 15, wherein the flaps are detachably fastened on the vest with one of their ends by means of snaps.

17. An athletic device for training the muscles of the upper body, in particular the arm muscles, in the course of running and walking, comprising a vest to be worn by a user, an elastically expandable flat rectangular cross sectioned strap removably disposed fastened in place across a back part of the vest and having at its ends two cuff means for connection to the arms or wrists of the user, further comprising a cover covering the shoulders and parts of the back, which is detachably connected with the vest and the expandable strap to form the athletic device.

* * * * *